United States Patent [19]

Atterbury

[11] 3,958,998

[45] May 25, 1976

[54] HOT TOP LINING SLABS AND SLEEVES

[75] Inventor: Robert Edwin Atterbury, Handsworth, England

[73] Assignee: Foseco Trading A.G., Switzerland

[22] Filed: Sept. 12, 1974

[21] Appl. No.: 505,388

Related U.S. Application Data

[63] Continuation of Ser. No. 260,360, June 7, 1972, abandoned.

[52] U.S. Cl. ..... 106/38.22; 106/38.25; 106/38.27; 106/38.3; 106/38.9; 249/197; 260/38; 260/42.17

[51] Int. Cl.[2] ..... B28B 7/36

[58] Field of Search ..... 106/38.22, 38.23, 38.25, 106/38.27, 38.3, 38.5 R, 38.9; 260/38, 42.17; 249/197, 201

[56] References Cited

UNITED STATES PATENTS

| | | | |
|---|---|---|---|
| 3,262,165 | 7/1966 | Ingham | 106/38.5 R |
| 3,456,914 | 7/1969 | Konrad et al. | 106/38.5 R |
| 3,558,591 | 1/1971 | Yendrek et al. | 106/38.35 |

*Primary Examiner*—Lorenzo B. Hayes

*Attorney, Agent, or Firm*—Wolfe, Hubbard, Leydig, Voit & Osann, Ltd.

[57] ABSTRACT

Flexible hot topping liners having improved properties comprise refractory, deformable, self-supporting, fibrous liners which have, in their dry condition, flexibility, restitution and droop characteristics within certain defined ranges. In the preferred embodiment, the extensibility and compressibility properties are also maintained within defined ranges. Flexible sealing rings for sealing the joint between a headbox and an ingot mould are also disclosed.

14 Claims, 8 Drawing Figures

HOT TOP LINING SLABS AND SLEEVES

RELATED APPLICATIONS

This is a continuation of application Ser. No. 260,360, filed June 7, 1972 now abandoned.

Ser. No. 24,021, filed Mar. 30, 1970, entitled "Hot Top Lining Slabs And Sleeves"; Ser. No. 134,023, filed Apr. 14, 1971, entitled "Sealing Rings For Headboxes", a continuation-in-part of Ser. No. 24,021; the present application being a continuation-in-part of Ser. Nos. 24,021 and 134,023.

This invention relates to the hot topping of ingot moulds or headboxes used in conjunction with ingot moulds and, more particularly, to materials for lining the heads of moulds intended for use in the casting of metal ingots and for lining headboxes used in conjunction with ingot moulds, to a method of hot topping including such materials, and to sealing rings for sealing the joint between a headbox and an ingot mould.

In the casting of metal ingots, as the metal cools, the outside of the ingot solidifies first since the freezing fronts advance inwards from the mould walls and the open top of the mould. Accordingly, unless steps are taken to allow for the shrinkage by providing a supply of liquid metal at the top of the solidifying mass, the final cooled shape will have fissures and cavities therein, the same often being termed "pipe".

Several methods are known to provide the necessary supply of molten metal at the top of the casting. For example, the ingot may be continually topped-up with additional liquid metal, or a large feed head of metal may be provided. Such methods are time-consuming and uneconomical.

It is therefore the typical commercial practice to provide a lining at the head portion of the mould or in a headbox which is placed on top of the mould, the lining serving to delay the rate of heat loss from the head metal. This lining may be made, for example, of ingredients which react with one another exothermically at the temperature of the molden metal to provide additional head to delay the solidification of the head metal. Alternatively, the liner may be made of heat-insulating materials which reduce the rate of loss of heat from the head. Both of these methods serve to maintain a head of liquid metal which will feed the ingot as it cools and contracts to prevent or reduce the formation of shrinkage cavities in the body of the ingot. In the production of metal castings, the feeder head or heads of the casting mould may be provided with a liner of exothermic or heat-insulating material. The linings are commonly formed of slabs or sleeves and these are generically referred to as hot-top lining slabs or sleeves.

While both exothermic and insulating linings are currently being used commercially, it is perhaps the most common practice to use insulating-type linings due to the relatively high cost of exothermic linings and also because on larger ingots which take longer to solidify, the exothermic reaction may be of too short duration to influence the later stages of solidification, the residue of the exothermic materials being a less efficient insulator than liners formulated solely for insulating purposes.

In spite of the considerable effort which has been directed to providing advantageous hot-topping materials and methods, as evidenced by the very considerable body of patent and other literature which has been published, the hot topping materials conventionally used are still subject to some disadvantages. These disadvantages stem partly from the form which these linings take, partly from the properties conferred by the materials used and partly due to the variation in the dimensions of the moulds or headboxes into which the linings must be fit.

In addition to suitable thermal properties, a satisfactory hot-top lining or sleeve must also have certain physical and mechanical properties. These properties can be subdivided between those desirable production, transport and in-plant handling of the materials, those which facilitate the application of the lining to the mould or headbox and those required when the materials are subjected to high temperature ferrostatic pressure during and after casting.

Of course, these properties must further be provided at a cost compatible with the benefits achieved by the use of a hot-top lining.

Commonly used insulators almost without exception are substantially rigid and exhibit low compressibility and flexibility. The liners typically possess a high transverse strength; but, when fracture occurs, it generally does so at a fairly low deflection. Stated another way, these rigid liners typically exhibit brittle fracture characteristics. Also, the liners have a high tensile strength and low elongation at fracture and may be further characterized as having densities generally in the range of 0.7–1.3 grams/cm.$^3$.

The high transverse strength of such insulator linings is certainly highly desirable in avoiding damage and breakage during transport and handling; but, in achieving sufficiently high values of transverse strength, the rigidity of the liner is also necessarily increased. While the increased rigidity would not be disadvantageous if the surface of the mould or headbox being lined was consistently an exact dimension with a smooth surface, problems are raised in actual practice because moulds and headboxes of nominally the same size often have large dimensional differences. Also, after use, rough, uneven surfaces may be developed. If a rigid slab or sleeve is used to line an ingot or headbox with a large dimensional difference or an uneven surface, the slab or sleeve will not lie against the surface being lined with continuous interfacial contact.

The resultant gaps between the lining and the mould or headbox thus constitute regions into which the molten metal may penetrate. When this occurs, the molten metal may force the lining to separate completely from the mould wall, thus removing the heat-insulting effect and even perhaps leading to a complete scrapping of the ingot. Even if the lining is not completely detached, the metal may form a fin or flash behind the lining, which not only makes removal of the ingot from the mould difficult but can also lead to defects during rolling of the ingot.

Still further, the seepage of metal may form a seal around the surfaces of the lining through which gases evolved when the molten metal contacts the hot-top liner would otherwise escape. This can result in the gases being forced to escape through the molten head metal itself, creating the phenomenon known as "boiling" which renders the process of casting both inefficient and sometimes even dangerous.

While the principal thrust of prior efforts has been directed towards the development of rigid, heat-insulating hot topping liners, there have been some attempts to produce highly resilient riser sleeves for metal casting (e.g. U.S. Pat. No. 3,456,914 to Konrad et al.). In addition, other prior efforts have employed fibrous components in forming liners for hot topping and other uses in metal casting.

Such lining materials inherently possess some degree of flexibility; however, typically, the principal reason for utilization of the fibrous component was not to provide flexibility. The desirability of forming hot topping liners with specified flexibility properties has apparently gone largely unrecognized.

Great Britian Pat. No. 534,739 to Schneider illustrates one type of a fibrous liner inherently having some degree of flexibility. These liners comprise thin paper-like elements of asbestos millboard. These were never intended for use as a hot-topping liner, but simply as a lining material placed adjacent the inner walls of an ingot mould. As the molten metal is introduced into the mould, the thin asbestos millboard liners act as a barrier to produce an ingot which, after cooling, possesses an improved surface finish compared to an ingot produced in the same mould without such a lining. Such paper-like linings are unsatisfactory for hot-topping purposes because they do not possess the requisite insulating properties.

Other prior fibrous liners, which inherently have some degree of flexibility and have adequate insulating properties for hot topping purposes, simply do not have the refractory character necessary for hot-topping liners, even when coated with a refractory dressing as is sometimes employed. More specifically, it is conventional in the art to test the adequacy of the refractoriness of hot-topping liners by carrying out a steel pour test. This comprises placing a ten inch cube steel box, the walls of which are 2 inches thick and the box being open at both ends, on a base of compacted molding sand. The four inner walls are lined with four insulating tiles (10 inches × 9 inches × 1 inch thick) of the liners being tested. Molten killed steel at 1600°C. is teemed into the box to a depth of nine inches. A powdered exothermic anti-piping compound is applied to the upper surface of the metal to give a layer one inch thick immediately after teeming to prevent premature solidification. The box and its contents are then allowed to cool to room temperature, and the box is removed together with the residue of the insulators. The metal surface of the solidified steel block adjacent the insulator and the insulator residue are examined with, respectively, the general quality of the metal surface and the extent of metal penetration being observed. A smooth metal surface is generally desirable, and metal penetration should be low since severe penetration illustrates insufficient insulating characteristics.

The prior art fibrous liners previously described, which inherently have some degree of flexibility, exhibit severe metal penetration and are thus, generally unsuitable for hot-topping applications.

Further difficulties arise when a headbox is used with an ingot mould since an adequate seal between the top of the mould body and the bottom of the headbox must be maintained. It is important to secure a seal which not only prevents the escape and consequent wastage of molten metal, but one which prevents molten metal extending over the rim of the ingot mould body. If molten metal does extend over the rim of the ingot mould body, it solidifies there and this tends to form a fin or flange which the solidifying ingot hangs. This generally leads to hanger cracks and tearing of the ingot during solidification, making the ingot unsuitable for further processing and resulting in scrapping of the ingot.

Heretofore, sealing of the joint between an ingot mould body and a headbox has been accomplished by a number of methods, none of which as been totally satisfactory. Previous proposals have included forming a gasket of asbestos rope or string or sealing the two components together with a mouldable sealing composition such as a mixture of grog and ball clay. Both these methods are difficult to carry out, particularly as to securing satisfactory positioning of the final seal so that, on the one hand, molten metal does not solidify over the rim of the mould body (and so lead to hanger cracking) and, on the other, no sealant material or asbestos rope projects into the mould cavity to form an inclusion in the soldified cast ingot.

A method which avoids the disadvantages just set forth involves the provision of a ring of bonded sand between the headbox and the mould body. This method, however, suffers from the disadvantages that the sand rings used cannot compensate for irregularities in the surface of the top of the mould body or underside of the headbox. Furthermore, under the weight of the headbox resting on the sand ring, the ring is liable to fracture or disintegrate.

Unitary sealing rings heretofore used, such as the sand rings herein described, are substantially rigid, having a low compressibility and a low flexibility. They possess a high transverse strength; but, when fracture occurs, it does so at a fairly low deflection. In other words, they exhibit brittle fracture characteristics. Also, such sand rings have a high tensile strength and low elongation at fracture. Still further, the densities are typically of the order of 0.7–1.5 gms./cu.cm.

The high transverse strength of such conventional materials is highly desirable in avoiding damage and breakage during transport and handling; but, in achieving sufficiently high values in this property, the rigidity of the materials is also increased. While this in itself would not be disadvantageous if the mating surfaces of the mould and headbox to be sealed together were exactly and consistently dimensioned and with smooth surfaces, it raises problems in practice. Moulds and headboxes of nominally the same size may have large dimensional differences and, during use, will often develop rough uneven surfaces. If such an ingot mould and headbox are sealed together with a rigid sealing ring, the sealing ring will not lie against the mating surfaces of the mould and headbox with continuous interfacial contact.

The resultant gaps between the sealing ring and the mould or headbox constitute regions into which the molten metal may penetrate. When this occurs, a fin or flash above the rim of the ingot mould body may be formed, leading to hanger cracking, or in severe cases, molten metal escaping from the mould completely.

It is an object of the present invention to provide hot top lining slabs and sleeves which are characterized by a specific combination of physical properties allowing substantially continuous interfacial contact with the surface being lined, regardless of dimensional variance or of the unevenness of the surface yet possess satisfactory refractoriness for hot topping applications.

Another object provides a hot top lining slab or sleeve capable of being deformed to fit the surface being lined wihout any significant tendency on the part of the slab or sleeve to return to its original shape. Stated another way, an object of the present invention is to provide a slab or sleeve wherein the deformation thereof is essentially plastic in character.

A further object lies in the provision of a lining slab or sleeve having physical properties such that, during the casting of an ingot, the slab or sleeve tends to adopt a wedge shape.

Yet another object of the present invention is to provide a lining slab or sleeve of the herein described type which allows incorporation of materials tending to shrink or disappear under the influence of the high temperatures encountered during casting without the creation of any significant, undesirable voids in the slab or sleeve.

A further object is to provide a flexible sealing ring to serve as a gasket or seal between a mould and a headbox or retaining ring.

Another object provides a lining slab or sleeve having sufficient flexibility such that it can be bent around corners of a relatively small radius to allow the lining of an ingot mould or headbox with a minimum number of separate slabs or sleeves. A related and more specific object lies in the provision of a lining slab or sleeve which allows complex shapes and configurations to be lined with relatively simple lining sleeve or slab shapes.

Other objects and advantages of the present invention will become apparent as the following description proceeds, taken in conjunction with the accompanying drawings, in which:

FIG. 1 is a schematic view and illustrating apparatus used to determine the flexibility (i.e. — load effected at a deformation of 0.7 cm.) and restitution (i.e. — percentage by which a sample will recover its original dimensions after being subjected to a load less than that required to cause it to pass its yield point) for hot top lining slabs, sleeves and sealing rings in accordance with the present invention;

Figure 8:
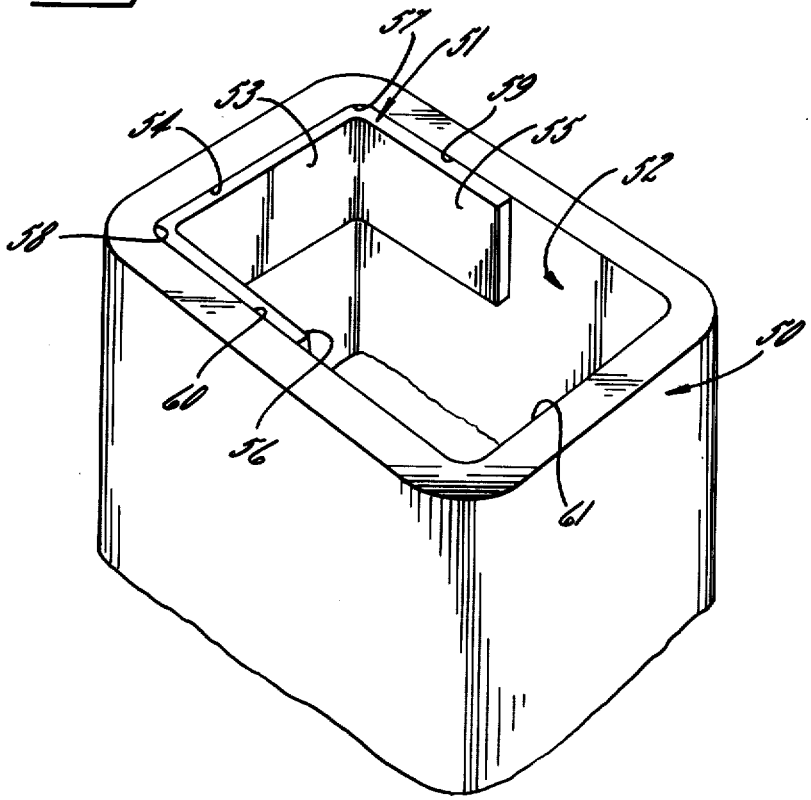
Figure 6:
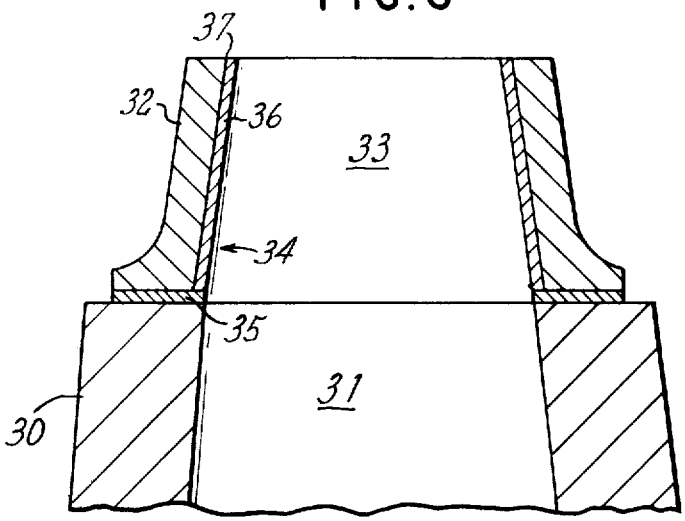
FIG. 6 is a schematic view, in cross-section, of an ingot mould with a superimposed headbox positioned thereon and showing a lining slab of the present invention against the headbox surface with an integral flange serving as a sealing ring for the joint between the mould and the headbox.
Figure 7:
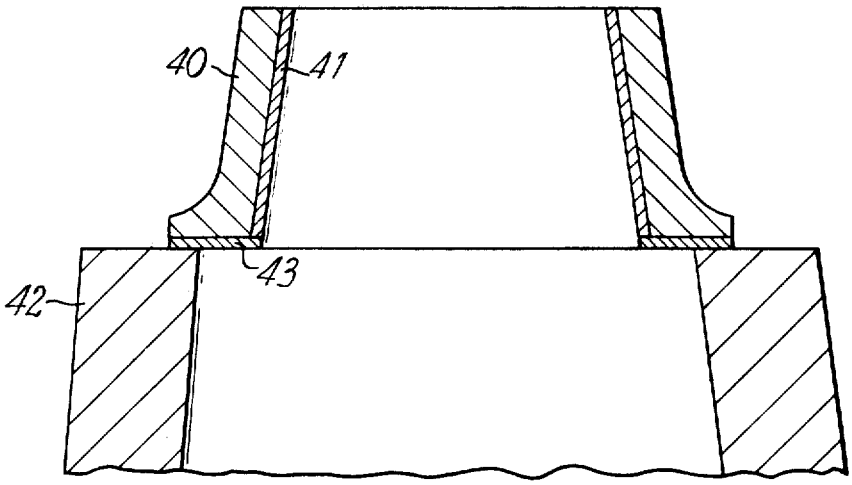

FIG. 7 is a schemaic view similar to FIG. 6, except showing another embodiment of a headbox with a separable liner and sealing ring; and FIG. 8 is a perspective view of an ingot mould and, partially cut away, to illustrate a further embodiment of the present invention wherein a pair of liners are employed (only one being shown for clarity of illustration), each being bent around a corner of the mould.

While the invention is susceptible of various modifications and alternative forms, certain specific embodiments thereof have been illustrated and will be described in detail herein. It should be understood, however, that it is not intended to limit the invention to the particular forms disclosed but, on the contrary, the invention is to cover all modifications, equivalents and alternatives falling within the spirit and scope of the invention.

In accordance with one aspect of the present invention, there is provided a hot top slab or sleeve comprising a refractory, deformable fibrous mat generally comprising organic and/or inorganic fibers, a particulate refractory material and optionally a low density filler and binder. The particular composition and selection of the types of materials used may vary within wide limits so long as the resulting hot top lining slab or sleeve has, in its dry condition, the following physical characteristics:

a flexibility such that the material deforms by 0.7 cm. without total fracture under a load not exceeding 20 Kg., a restitution value of not more than 30% and a droop value of not more than 17 cm. and also possesses sufficient refractoriness for hot topping applications. Preferably, the lining slab or sleeve has a compressibility value of 0.1 to 1.6 Kg./cm.$^2$ and/or an extensibility of at least 0.5 cm. under a load not exceeding 50 Kg. This combination of properties provides a hot top lining slab or sleeve having advantageous characteristics, as will be described hereinafter as will be the tests and apparatus for determining the various properties.

The fibrous mat may comprise either inorganic fibers and/or organic fibers, the latter being either synthetic or natural fibers. Suitable examples of inorganic fibers include asbestos, slag wool, rock wool, alumino silicate fibers, calcium silicate fibers and carbon fibers. Representative examples of organic fibers include regenerated cellulose, cellulose acetate, polyacrlonitrile, polyethylene terephthalate, nylon, cotton, wool, hemp, jute, flax, hessian and sisal. The organic fibrous component may also include very short fibrous materials such as wood pulp, paper pulp and the like. The particular amount and type of fibrous material which is used must, of course, be coordinated with the other components used to form a lining slab having the desired physical properties and refractoriness.

In a preferred form of the present invention, the fibrous constituent consists of fibrous material having a fiber length of at least 0.25 cm. and a length-to-diameter (L/D) ratio of at least 100:1. The proportion of fiber with this length and L/D ratio is preferably 3 to 50% by weight of the total composition. The optimum proportion will be dependent on the nature of the particular fibers used, including its physical characteristics such as, for example, extensibility, flexibility and the ability to felt as well as the specific nature of the other ingredients used as has been herein discussed.

Suitable particulate refractory materials, when present in the fibrous mat include, by way of example, silica, grog, chamotte, sillimanite, magnesia, olivine, alumina and zircon. Particularly good results have been obtained by the use of calcined rice husks. Low density fillers such as diatomaceous earth, bloated clay, vermiculite, perlite, obsidian and bubble alumina may also optionally be included. While the particle size of the refractory materials and the low density filler is not particularly critical, it is preferred to employ a particle size no greater than about minus 12 ASTM.

To provide improved mechanical strength, a minor amount of a binding agent may also optionally be added. Representative examples of binding agents include synthetic resins such as urea-formaldehyde, phenolformaldehyde, furane and polyvinyl acetate, phosphates of various types, colloidal oxide hydrosols such as silica sol and alkyl metal silicates such as sodium silicate.

In some instances, the fibrous mat has satisfactory strength without the inclusion of an added binding agent. This is often the case, for example, when the compositions include very short fibered materials such as wood pulp, paper pulp and the like, the binding action being achieved from the small resinous content of such materials or merely by the action of the fibers in filling the gap between the other components.

In general, the organic fibrous content may vary, by weight of the total composition from an amount of about 0 to 53% and the inorganic fibrous content from about 0 to 60%, with the total fibrous content being from about 6 to 75%. The particulate refractory material may vary from about 25 to 94% by weight of the total composition. The optional inclusion of the low density filler is typically from about 0 to 30% by weight. When used, the binder may be present in an amount up to about 4% by weight.

It is preferable to select the ingredients forming the slabs or sleeves and the manufacturing conditions to provide a slab or sleeve density of less than 0.7 gm./cc., preferably from 0.2 to 0.5 gm./cc.

An exemplary composition for forming the slabs and sleeves of the present invention comprises a refractory, heat-insulating material comprising inorganic fibrous material, organic fibrous material and particulate refractory filler, which is free or substantially free from a binder. The total fibrous material constitutes at least 45% by weight of the material, and the total organic fibrous material and particulate refractory filler constitute not more than 75% by weight of the material. The inorganic fiber preferably has a length to diameter ratio of over 600:1. Typical fibers are 3 mm. in length with a diameter of 0.005 mm.

The slabs or sleeves of the present invention are conveniently formed by making an aqueous slurry suspension of the solid constituents of the composition and then depositing the solids on a mesh former by expressing the liquid medium of the slurry through the mesh, by pressure and/or vacuum, leaving a layer of the solid ingredients on the mesh. The slurry preferably contains not more than 5% by weight solids, more preferably about 1.5 to 2.5%; and the pressure used is desirably within the range of from about 20 to 100 p.s.i. and the vacuum in the range of from about 5 to 14 p.s.i., preferably from about 7 to 8.

The liquid medium of the slurry should be expressed to provide a resulting layer with a smooth surface, even thickness and uniform distribution of the components. The resulting layer should have sufficient green strength so that it may be handled after stripping from the mesh surface so that it may be dried by any convenient means, such as, for example, by passage through a heated chamber. The final product should have a moisture content which is in balance with the ambient atmosphere, and the reference to the slabs and sleeves in the dry condition has that meaning.

Figure 1:
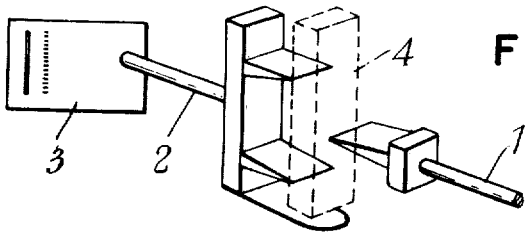
Figure 3:
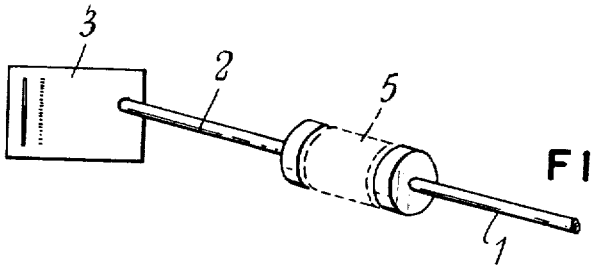
FIG. 3 is a schematic view and illustrating apparatus for determining the compressibility value (i.e. — pressure in Kg./cm.$^2$ required to compress a sample by one-tenth of its thickness) of liners and sealing rings in accordance with the present invention.
Figure 4:
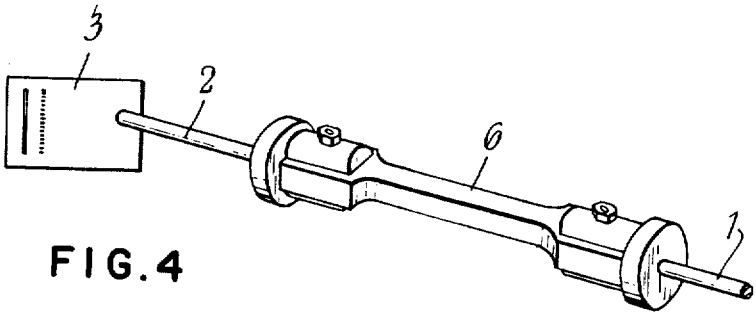
FIG. 4 is a schematic apparatus and illustrating a means of determining the extensibility value (i.e. — the load in Kg required to elongate a sample 0.5 cm.) of a hot top lining slab and sealing ring in accordance with the present invention.

As has been herein discussed, the resulting slab or sleeve must have physical properties such that its flexibility, restitution and droop, and preferably its compressibility and extensibility, lie in the ranges as herein identified. Turning to the figures, there is schematically shown apparatus for determining the desired physical characteristics of the slabs and sleeves, which applicant has devised. A commercially available "Hounsfield Tensometer" (Tensometer Limited, Croydon, Surrey, England), may suitably be used. This is a universal testing machine for carrying out tests such as tensile, compression, and the like on plastics, textiles, etc. in which a stress/strain curve is obtained. Referring now to FIGS. 1, 3 and 4, there is diagrammatically shown an apparatus in which a pair of members 1, 2 can be adjustably moved apart or toward one another, by movement of member 1. The relative movement between the members 1 and 2 can be measured, and in addition, the force exerted on member 2 may be measured by a mercury column device 3. The results obtained are recorded graphically by plotting the force, or load values registered, against the corresponding dimensional changes. Thus, stress/strain curves are generated which illustrate and quantify the physical characteristics herein before referred to.

To carry out the flexibility and restitution tests, the apparatus is assembled with a specimen 4 as shown in FIG. 1. The knife edges on members 1 and 2 are 17.6 cm. apart and are each 5.1 cm. wide with a test specimen having a size of 20 cm. by 5.1 cm. by 2.5 cm. thick. The specimen size was selected as being representative for hot top lining slab and sleeve applications wherein the thickness of liners in accordance with the present invention is typically of the order of about 2.5 cm. (e.g. — 1 1 inch).

Flexibility of the sample is then determined by moving the members 1 and 2 toward one another until either the relative movement between 1 and 2 reaches 1.2 cm. or the load either reaches 60 Kg. or falls to zero, whichever occurs first.

To measure the restitution value, the flexibility test is repeated; and the movement is stopped just short of the point at which further movement of the member 1 would cause the load to diminish, i.e. — the "yield point", if the existence of such a point has been indicated by the flexibility test, or at 1.2 cm., whichever is the shorter distance. This distance is $E_1$; and, when dealing with flexible materials having physical properties in accordance with the present invention, the distance will generally be 1.2 cm. The members are then moved apart, and the point ($E_2$) at which the load drops to zero is noted. The restitution value (in percent) is calculated as $$\frac{E_1 - E_2}{E_1} \times 100.$$

Figure 2:
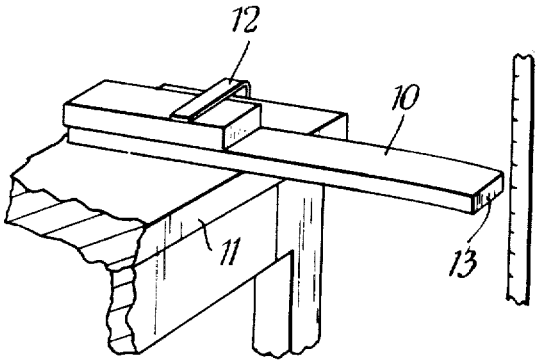
FIG. 2 is a schematic view and showing apparatus for determining th droop value (i.e. — distance in centimeters from horizontal through which remote edge of the overhang area of a sample will fall in a specified time) of liners and sealing rings in accordance with this invention.

To carry out the droop test, as shown in FIG. 2, a strip of the test material 10, 2.5 cm. thick and projecting 25 cm. over the edge of a horizontal table 11 is clamped by a clamp 12 above at the edge of the table. The distance in centimeters through which the lower edge 13 of the strip of material remote from the table has fallen under its own weight after 20 seconds is the droop value.

The compression test may be carried out using the Hounsfield Tensometer, set up as diagrammatically shown in FIG. 3, a specimen 5 being a cylinder of 5.1 cm. in diameter. The members 1 and 2 are moved together as described in connection with FIG. 1; and the compressibility value is obtained from the load required to compress the specimen to 90% of its original thickness, the value being expressed in Kg./cm.$_2$.

The extensibility is determined by using the apparatus shown in FIG. 4, the specimen 6 being 2.5 cm. thick and 30.5 cm. long. The end portions are each 5.1 cm. wide and 6.6 cm. long, the fixture holes being 2.5 cm. from each end. The width of the central portion is 3.8 cm. The members 1 and 2 are moved apart until the load either reaches 50 Kg. or falls to zero. The load is Kg. at an elongation of 0.5 cm. is the extensibility value. A metal bridge is desirably used to support the members 1 and 2 to prevent the jaws from falling and inducing a stress or force on the sample. Rollers (not shown) may be positioned on the members 1 and 2 to minimize frictional effects.

A certain amount of friction is typically recorded on the mercury column merely by movement of the members 1 and 2 together or away from each other. To minimize these frictional effects when conducting any of the tests hereinbefore identified except for droop, the members 1 and 2 should be moved wide apart and then moved toward each other with the adjusted zero point on the mercury column being the point registered on the column caused by the movement. With samples having a rough or uneven surface it is also desirable to move the member 1, with the specimen being tested in place, until the mercury column begins to rise with the point at which the column begins to move becoming the zero point.

By combining the fibrous and other constituents forming the slab or sleeve in accordance with the present invention so as to have the physical characteristics as herein defined, the resulting slabs and sleeves provide important and practical advantages. Due to their characteristics of flexibility and restitution (elastic recovery), lining slabs and sleeves of a particular nominal size may be made to fit cavities (i.e. — the cavity at the end of an ingot mould or within a headbox) by deforming the slabs or sleeves under relatively low pressure without there being any significant tendency for the slab or sleeve to revert to its original shape, i.e. — the deformation is essentially plastic in character.

A second advantage arises from the configuration assumed by such a slab or sleeve during the casting of an ingot. In casting, due to the thickness of the side-lining insulator lining, a "shoulder" will be formed on the solidified ingot at the hot top junction. The presence of this shoulder on the solidified ingot can itself give rise to defects during the subsequent rolling or processing of the ingot which can adversely affect the yield of sound metal. Because the maximum ferrostatic pressure will occur at the bottom of the hot-top lining, i.e. — at the shoulder, the lining slabs or sleeves of the present invention, due to their physical properties, automatically tend to adopt a wedge shape with the thickness of the slab or sleeve reduced to a maximum extent at this shoulder region. The shoulder is thus thereby eliminated or at least significantly reduced in size.

To obtain reduced densities and improved thermal performance, it is often convenient to incorporate into a liner components which shrink or disappear completely under the influence of the high temperatures encountered in contact with molten steel. When rigid incompressible linings are used, the formation of voids due to such components create fissures on the interface surface of the slabs or sleeves into which molten metal can penetrate thereby effecting the yield of the solidified metal. The slabs or sleeves of the present invention cause such voids to close up under the ferrostatic pressure created during casting.

Because the lining slabs and sleeves of the present invention have no tendency to spring away from the wall when a deforming force is removed, adhesives may be used as a convenient means of securing the slabs and sleeves to the wall of a mould or headbox.

The physical properties of the present invention also allow linings to be supplied in a flat form minimizing the package space required yet which can be deformed to fit cambered walls. Relatively low deformation pressure attained either by hand or by a simple application jig will allow lining such cambered walls or other complex shapes and configurations encountered in moulds and headboxes with basically simple (e.g. — corrugated, fluted or polygonal) shapes of lining materials.

It should be appreciated that the flexibility and droop should not be so great as to make the materials difficult to handle due to excessive droop which makes the lining process more difficult. Similarly, the compressibility should not be such that, under ferrostatic pressure, the thickness of the slab or sleeve is decreased to an extent that the thermal performance is reduced to the detriment of the yield of sound metal. Maintaining the physical properties of the slabs within the levels hereinbefore set forth obviate these potential problems.

The slabs or sleeves of the present invention may be formed as a single integral layer or may consist of two or more layers. Multi-layer slabs may be formed by depositing different compositions into position by the use of two or more slurries in succession on the mesh former. It is the physical characteristics of the final or resulting slab or sleeve which must be maintained as herein described; so that it is possible to make up a multi-layer slab or sleeve including one or more layers of which, if used alone, would not have the required characteristics.

Also, while the slabs or sleeves of the present invention have satisfactory refractory properties so as to meet the steel pour test described herein, the slabs or sleeves may be provided with a thin surface coating such as, for example, a coating of a refractory dressing on the side facing the molten metal, to aid in resisting penetration of the slab by the molten metal. Suitable materials for refractory dressings include, for example, suspensions of zircon, silica or chromite flour.

To line an ingot mould head or headbox in accordance with the present invention, a lining slab or sleeve having the hereinbefore defined physical properties is provided, is inserted into the cavity to be lined and is then pressed so as to deform and compress it into contact with the walls of the cavity. The deformed slab or sleeve is allowed to remain in place and is secured or caused to adhere to the cavity walls in the thus-deformed position. Slabs or sleeves in accordance with the present invention may possess in and of themselves sufficient resilience so that, when applied and deformed, they remain in place without the use of any additional fastening means such as clips, nails, adhesive or the like.

Figure 5:
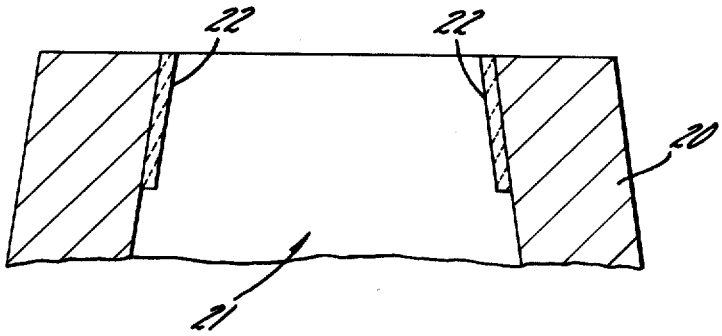
FIG. 5 is a schematic view of a ingot mould in cross-section and illustrating a hot top lining slab, in accordance with the present invention deformed into position against the head portion of the mould.

FIG. 5 illustrates a hot top slab in accordance with the present invention lining the head portion of an ingot mould. As shown, an ingot mould 20, having a head portion, generally indicated at 21, has a hot top slab 22 deformed into contact with the end portion surface.

In accordance with a further aspect of the present invention, the flexible, fibrous mats having the physical properties described hereinbefore may function as a sealing ring for the joint between an ingot mould and a superimposed headbox. Due particularly to their characteristics of compressibility, flexibility and restitution (elastic recovery), sealing rings of a particular nominal size and of regular shape may be made, by low deformation processes, to fit the joint between the upper surface of an ingot mould body and the lower surface of a headbox without there being too great a tendency for the ring to revert to its original shape. Adhesives may be used as a very convenient means of securing the flexible rings to the lower surface of a headbox since the ring has no tendency to spring away from the surface when the force used to apply the ring to that surface is removed. The sealing ring may be integral or, if deired, formed from two or more sections which, when placed in juxtaposition, constitute a complete ring.

When used as a sealing ring, it is essential that the flexible fibrous mat employed have compressibility and flexibility values within the ranges previously described for lining slabs. The restitution value of the flexible mat should also be within the range set forth for lining slabs. The droop value is probably the least important physical property. However, when the flexible mat of the present invention has the proper compressibility and flexibility values, the droop value will generally be in the range set forth for hot top lining applications.

In accordance with a still further aspect of the present invention, a unitary sealing ring-hot top lining slab assembly is provided. To this end, materials having the herein described physical properties are formed in the shape of a sealing ring (or a section thereof) with the inner periphery of the ring merging continuously into a lining for the headbox.

Thus, as shown in FIG. 6, there is provided an ingot mould 30 with a cavity 31 and a headbox 32 with a cavity 33 superimposed thereon. In keeping with this embodiment of this invention, a sealing ring-hot top lining slab assembly generally indicated at 34 is provided. Assembly 34 consists of a sealing ring section 35 serving as a gasket for the joint between the mould 30 and the headbox 32 and positioned therebetween and an integral hot top lining slab section 36 deformed into contact with the interior wall 37 of the headbox 32.

FIG. 7 shows a further embodiment wherein the sealing ring of the present invention is not integral with the hot top lining slab. As illustrated, a headbox 40 lined with a hot top slab 41 rests on ingot mould 42 with a sealing ring 43 separable from the slab 41 interposed between the mould-headbox joint. In this embodiment, the sealing ring matches the inner periphery of the headbox but not that of the ingot mould; this compensates for wide variations in the ingot mould dimensions.

The physical dimensions of the sealing rings will vary with the circumstances accompanying differing usage; the thickness will, generally, be in the range of 25 to 40 mm., and the width at least 75 mm. The width of contact of the sealing ring with the upper surface of mould body is preferably at least 25 mm. The maximum width of the ring is preferably about 170 mm. for most applications. The area of the aperture in the sealing ring should not be less than 45% of the area of the top opening of the ingot mould body; and, in order to give satisfactory rolling characteristics to the cast ingot, the area of opening of the ring should preferably be about 60% of the area of the top opening of the ingot mould body.

While desirable for certain applications, it should be appreciated that the inner and outer periphery of the sealing rings of this invention need not be circular. Any other geometric shape may be employed; and, as a specific example, the plan of the rings may be generally square or rectangular, with straight or slightly curved sides. Other shapes such as hexagonal may also be used.

The sealing rings may be formed in the same fashion as the slabs and sleeves, i.e. — by forming a dilute aqueous slurry of the solid constituents, depositing the solids on a mesh former by expressing the liquid through the mesh and drying. While the type of components and their amounts may vary within wide limits consistent with providing the necessary physical properties as described herein, a particularly advantageous sealing ring may be formed from the following materials, the percentages being by weight:

| | |
|---|---|
| long fibers (e.g. organic such as rayon or inorganic such as fiberglass) | 2–30%, e.g. –6 |
| asbestos | 0–20%, e.g. –15 |
| resin binder (e.g. phenolformaldehyde resin) | 1–6%, e.g. –4 |
| particulate filler (e.g. sand, silica flour) | 60–85%, e.g. –75 |
| low density filler (e.g. diatomaceous earth) | 0–30%, e.g. –25 |
| surfactant | 0–2%, e.g. –0.5 |

Materials of this formulation typically possess a compressibility of 0.1 to 1.0 kg/cm$^2$.

In accordance with yet another aspect of the present invention, an ingot mould or a headbox may be lined with a minimum number of separate slabs. To this end, because flexible slabs having the physical properties identified herein may be bent around corners of a quite small radius (e.g. — about 8 cm.), an ingot mould (or a headbox) may be lined for hot topping purposes by using only two slabs. A specific example is shown in FIG. 8 wherein an ingot mould 50 has a first flexible slab 51 positioned in the head portion 52 of the ingot mould. The central portion 53 of the flexible slab 51 lines a first interior wall 54 of the mould; and the end portions 55 and 56, bent around corners 57 and 58, respectively, extend along and line a portion of walls 59 and 60, respectively, terminating at about the center of these walls. To complete the hot topping, a second slab (not shown) would then be positioned opposite from the first slab with its central portion lining a second wall 61. The second slab would be sized complementally with the first slab so that its end portions would abut against the terminal portions of end portions 55 and 56 to complete the lining.

To assemble the two-slab embodiment of FIG. 8, the first slab is inserted into the cavity being lined and deformed or pressed into contact with the walls of the cavity. The slab may possess sufficient resilience so that it will remain in position without the use of any clips, nails, adhesive or the like. However, if desired, the first slab may be temporarily held in place with, for example, a reusable clip. The second slab is then inserted into the cavity, aligned opposite the first slab so that the end portions of each slab abut and deformed into position as previously described, after which the clip may then be removed.

The following examples are intended to be illustrative, but not in limitation, of the present invention. Unless otherwise set forth, all percentages are by weight.

EXAMPLE 1

An insulator material was made up of:

| | |
|---|---|
| amosite asbestos | 15% |
| cut synthetic organic fiber | 15% |
| cellulose fiber | 3% |
| calcined rice husks | 20% |
| sand | 45% |

A 3% aqueous slurry was prepared from these ingredients, and a quantity of the slurry was pumped into a chamber having a perforated gauze base. Air pressure (40 p.s.i.) was applied to the upper surface of the slurry in the chamber, and the water was thereby expressed through the gauze to leave a damp ring of slurry solids thereon. A layer of 25 min. thickness was built up. The damp liner was removed from the chamber and transferred to an oven maintained at a temperature of 160°–180°C. for three hours, after which it was a flexible, self-supporting sleeve of satisfactory handleability.

The liner was applied to the outside of a flexible sleeve formed from the insulator material with an adhesive comprising a sodium silicate solution of 50% solids, $SiO_2$:$Na_2O$ ratio 2:1. This was then placed in the head of an ingot mould and expanded to abut the mould walls throughout the whole of its periphery. The silicate adhesive secured the lining firmly in place and a steel ingot was subsequently cast in the mould with hot top performance being satisfactory.

The physical characteristics of the sleeve were as follows:

| | |
|---|---|
| Flexibility value | 2.7 Kg. |
| Resititution value | 10% |
| Droop value | 0.6 cm. |
| Compressibility value | 1.8 Kg./cm.$^2$ |
| Extensibility value | 2.0 Kg. |

EXAMPLE 2

The insulator of Example 1 was used but instead of applying sodium silicate to the insulator, the following adhesive was applied: an aqueous emulsion of polymerized alkyl acrylate or solution of polymerized alkyl acrylate in a suitable solvent, e.g. isopropyl acetate.

The water or solvent is evaporated to leave an adhesive coating on the lining material, which material may then be suitably packed and/or stored. Suitable packing is siliconized or similar release paper over the adhesive layer, followed by any conventional packing steps required.

When required for use, the release paper is peeled away and the lining may then be adhered in the head of an ingot mould without difficulty.

EXAMPLE 3

A 2% solids content slurry was made up in water, the solids ingredients being present in the following relative proportions:

| | |
|---|---|
| Aluminosilicate fibers | 35% |
| Cellulose fiber | 15% |
| Calcium silicate fibers | 10% |
| Asbestos | 15% |
| Silica flour | 25% |

The slurry was pumped into a chamber as in Example 1, with a sleeve being formed as set forth in that example. Handleability of the sleeve was satisfactory, and the sleeve gave satisfactory results when used to line a riser in a test cast iron casting.

The physical characteristics of the sleeve were as follows:

| | |
|---|---|
| Flexibility value | 1.5 Kg. |
| Restitution value | approx. 3% |
| Droop value | less than 1 mm. |
| Compression value | 0.31 Kg/cm$^2$ |
| Extensibility value | 2.0 Kg. |

EXAMPLE 4

Table 1 sets forth further examples of compositions which provide hot top slabs and sleeves in accordance with the present invention:

Table 1

| Composition | Cellulose fibre | Refractory filler | Low-density filler | Cut synthetic organic fibre | Fibrous Refractory | Organic Binder | Refractory filler (fine) | Alumino silicate fibres | Calcium silicate fibre |
|---|---|---|---|---|---|---|---|---|---|
| A | 3 | 53 | 20 | 9 | 15 | | | | |
| B | 3 | 53 | 20 | 9 | 15 | 0.3 | | | |
| C | 3 | | 20 | 9 | 15 | 1 | 52 | | |
| D | 3 | 16 | | 50 | | | 31 | | |
| E | 3 | 16 | | | 50 | | 31 | | |
| F | 3 | 16 | | | | | 31 | 50 | |
| G | 3 | 16 | | | | | 31 | | 50 |
| H | 3 | 32 | | 3 | | | 62 | | |
| I | 3 | 31 | | 6 | | | 60 | | |
| J Facing layer | 5 | | 10 | | | | 85 | | |
| Backing layer | 5 | 55 | 20 | 5 | | | | | 15 |
| K Facing layer | 5 | | 10 | | | | 85 | | |
| Backing layer | 5 | 55 | 20 | 5 | | 0.3 | | | 15 |

The physical properties of the sleeves made from the compositions set forth in Table 1 are shown in Table 2:

Table 2

| | Flexibility value (Kg) | Restitution value (%) | Droop value (cms) | Compressibility value (Kg/cm²) | Extensibility value (Kg) |
|---|---|---|---|---|---|
| A | 0.91 | 1 | 1.6 | 0.17 | 6.8 |
| B | 5.9 | 25 | 0.2 | 0.54 | 1.4 |
| C | 4.1 | 2 | 1.6 | 0.45 | 8.6 |
| D | 1.4 | 2 | 1.0 | 0.20 | 1.6 |
| E | 0.7 | 2 | 1.0 | 0.18 | 4.5 |
| F | 0.7 | 2 | <0.1 | 0.045 | 1.2 |
| G | 1.8 | 4 | 0.1 | 0.10 | 8.0 |
| H | 4.5 | 5 | 0.2 | 0.72 | 5.5 |
| I | 4.5 | 3 | 0.2 | 0.90 | 4.1 |
| J | 6.4 | 21 | <0.1 | 0.60 | 11.5 |
| K | 12.0 | 17 | <0.1 | 1.30 | 13 |

EXAMPLE 5

Further compositions that may be utilized to form hot top sleeves in accordance with this invention are set forth in Table 3:

Table 3

| | Rayon 1½denier | Asbestos | Silica | Silica flour | Surfactant | Phenol formaldehyde resin |
|---|---|---|---|---|---|---|
| L | 6 | 15 | 26.5 | 52 | 0.5 | 0 |
| M | 6 | 15 | 25.5 | 52 | 0.5 | 1 |
| N | 6 | 15 | 24.5 | 51 | 0.5 | 3 |
| P | 6 | 15 | 24.5 | 50 | 0.5 | 4 |
| Q | 9 | 15 | 22.5 | 52 | 0.5 | 1 |
| R | 9 | 15 | 22.5 | 51 | 0.5 | 2 |
| S | 12 | 15 | 19.5 | 52 | 0.5 | 1 |
| T | 15 | 15 | 16.5 | 52 | 0.5 | 1 |

EXAMPLE 6

An insulator material was made up of:

| | |
|---|---|
| amosite asbestos | 15% |
| rayon fiber | 6% |
| diatomaceous earth | 24.5% |
| sand | 50% |
| phenolformaldehyde resin | 4% |
| surfactant | 0.5% |

A 5% aqueous slurry of these ingredients was prepared, and the following procedure carried out: A quantity of this slurry was pumped into a chamber on the base of which was a ring-shaped area of perforated gauze. Air pressure (40 p.s.i.) was then applied to the upper surface of the slurry in the chamber and this expressed the water through the gauze to leave a damp ring of slurry solids thereon. A layer of 30 mm. thickness was built up.

The damp ring of material so formed was then removed from the chamber. The ring was pliable in the green state. The ring was dried in an oven for three hours at 160°–180°C., after which it was a flexible self-supporting ring of satisfactory handleability.

This ring was clipped to the bottom of a headbox casting already lined with refractory insulating material, and the assembled hot top placed on top of the mould body. Molten steel was then teemed into the mould. No leakage or finning occurred at the junction between mould and headbox.

The physical characteristics of the ring were:

| | |
|---|---|
| Flexibility value | 3.2 Kg. |
| Restitution value | 9.1% |
| Droop value | 0.6 cm. |
| Compressibility value | 0.2 Kg./cm.² |
| Extensibility value | 5.7 Kg. |

In place of the assembly technique used above, the sealing ring can be adhered to the underside of the headbox with a suitable adhesive (e.g. — sodium silicate) and the assembly of headbox and sealing ring then lowered onto the mould body.

EXAMPLE 7

A ring made according to Example 6 was used, and the following adhesive was applied to one side thereof: an aqueous emulsion of polymerized alkyl acrylate or solution of polymerized alkyl acrylate in a suitable solvent, e.g. isopropyl acetate.

The water or solvent is evaporated to leave an adhesive coating on the ring, which may then be suitably protected, as by a siliconized or similar release paper over the adhesive layer.

When required for use, the release paper is peeled away and the ring may then be adhered to the top surface of an ingot mould body or to the underside of a headbox without difficulty.

EXAMPLE 8

A 2% solids content slurry was made up in water, the solids ingredients being present in the following relative proportions:

| | |
|---|---|
| Aluminosilicate fibers | 35% |
| Cellulose fibers | 15% |
| Calcium silicate fibers | 10% |
| Asbestos | 15% |
| Silica flour | 25% |

Into a tank of such slurry was immersed a porous ring-shaped mesh former and suction was applied to deposit a ring of material on the mesh. The so formed ring of material was stripped from the former and found to be pliable in the green state, and self-supporting after drying in an oven. Handleability of the ring was satisfactory, and the ring gave satisfactory results when used to seal the joint between an ingot mould and a headbox.

The physical characteristics of the sleeve were as follows:

| | |
|---|---|
| Flexibility values | 1.5 Kg. |
| Restitution value | approx. 3% |
| Droop value | less than 1 mm. |
| Compression value | 0.31 Kg/cm² |
| Extensibility value | 2.0 Kg. |

EXAMPLE 9

Table 4 sets forth further examples of compositions which provide sealing rings in accordance with the present invention:

Table 4

| Composition | Cellulose fibre e.g. paper pulp | Refractory filler e.g. silica and | Low-density filler e.g. diatomaceous earth | Cut synthetic organic fibre e.g. rayon | Inorganic fibers e.g. asbestos | Organic Binder e.g. phenol formaldehyde resin | Refractory filler (fine) e.g. silica flour | Calcium Silicate fibre |
|---|---|---|---|---|---|---|---|---|
| A | 3 | 53 | 20 | 9 | 15 | | | |
| B | 3 | 53 | 20 | 9 | 15 | 0.3 | | |
| C | 3 | | 20 | 9 | 15 | 1 | 52 | |
| D | 3 | 16 | | 50 | | | 31 | |
| E | 3 | 16 | | | 50 | | 31 | |
| F | 3 | 47 | 20 | 15 | 15 | | | |
| G | 3 | 16 | | | | | 31 | 50 |
| H | 3 | 32 | | 3 | | | 62 | |
| I | 3 | 31 | | 6 | | | 60 | |

The physical properties of sealing rings made from the compositions set forth in Table 1 are shown in Table 5:

Table 5

| | Flexibility value (Kg) | Restitution value (%) | Droop value (cms) | Compressibility value (Kg/cm²) | Extensibility value (Kg) |
|---|---|---|---|---|---|
| A | 0.91 | 1 | 1.6 | 0.17 | 6.8 |
| B | 5.9 | 25 | 0.2 | 0.54 | 1.4 |
| C | 4.1 | 2 | 1.6 | 0.45 | 8.6 |
| D | 1.4 | 2 | 1.0 | 0.20 | 1.6 |
| E | 0.7 2 | 1.0 | 0.18 | 4.5 | |
| F | 2.7 | 10 | 0.6 | 1.8 | 2.0 |
| G | 1.8 | 4 | 1.4 | 0.10 | 8.0 |
| H | 4.5 | 5 | 0.2 | 0.72 | 5.5 |
| I | 4.5 | 3 | 0.2 | 0.90 | 4.1 |

EXAMPLE 10

Table 6 illustrates still further examples of compositions having the physical characteristics required for use as sealing rings in accordance with the present invention:

Table 6

| | Rayon 1½ denier | Asbestos | Silica | Silica flour | Surfactant | Phenol formaldehyde resin |
|---|---|---|---|---|---|---|
| J | 6 | 15 | 26.5 | 52 | 0.5 | 0 |
| K | 6 | 15 | 25.5 | 52 | 0.5 | 1 |
| L | 6 | 15 | 24.5 | 51 | 0.5 | 3 |
| M | 9 | 15 | 22.5 | 52 | 0.5 | 1 |
| N | 9 | 15 | 22.5 | 51 | 0.5 | 2 |
| O | 12 | 15 | 19.5 | 52 | 1 | |
| | | | | 0.5 | | |
| P | 15 | 15 | 16.5 | 52 | 0.5 | 1 |

EXAMPLE 11

A still further example of a composition having the physical characteristics required for use as a hot-top lining slab, sleeve or sealing ring in accordance with the present invention is as follows:

| | |
|---|---|
| Silica flour | 46.0% |
| Diatomaceous earth | 31.5% |
| Calcium silicate fibre | 13.5% |
| Alumino-silicate fibre | 4.5% |
| Phenol-formaldehyde resin | 4.5% |

Thus as has been seen, the present invention, by combining fibrous and other ingredients to form materials with flexibility, restitution and droop properties within defined limits provide lining slabs and sleeves which have sufficient strength to withstand handling during packing, transport and handling in use. A minimum gas permeability is achieved, as is required, to enable gases evolved due to contact with the molten metal to escape through the slab or sleeve. The typically low density achieves good heat as well as providing easier handling. The slab and sleeve retain sufficient mechanical strength after insertion into hot ingot moulds prior to teeming, and the residue is easily removable from the ingot to prevent contamination of the metal. When such flexible materials have the required compressibility, flexibility and restitution values, the slabs also form superior sealing rings for sealing the joint between an ingot mould and a headbox; and, one aspect of this invention provides an integrally formed sealing ring and hot top liner for the headbox. Because of the desirable flexibility and deformability properties, an ingot or a headbox may be lined with but two slabs.

I claim as my invention:

1. A hot top lining slab or sleeve which comprises a refractory, deformable, self-supporting, substantially uniform fibrous mat having in its dry condition a flexibility such that the material deforms by 0.7 cm. without total fracture under a load not exceeding 20 Kg., a restitution of not more than 30%, a droop value of not more than 17 cm, a compressibility value of 0.1 to 1.6 Kg./cm.², and an extensibility value not exceeding 50 Kg.

2. A hot top lining slab or sleeve according to claim 1 wherein the fibrous mat includes at least 3% by weight of fibers having a length of at least 0.25 cm. and a length to diameter ratio of at least 100:1.

3. A hot top lining slab or sleeve according to claim 1 wherein the fibrous mat includes inorganic fibers.

4. A hot top lining slab or sleeve according to claim 1 wherein the fibrous mat includes organic fibers.

5. In a hot top lining slab or sleeve comprising a fibrous mat of at least one element selected from the group consisting of organic and inorganic fibers and a particulate refractory material contained in the mat, the improvement wherein the fibrous element and particulate material are present in an amount sufficient to provide a refractory, deformable, self-supporting, substantially uniform fibrous mat having in its dry condition a flexibility such that the mat deforms by 0.7 cm. without total fracture under a load not exceeding 20 Kg., a restitution of not more than 30%, a droop of not more than 17 cm, a compressibility value of 0.1 to 1.6 Kg/cm.$^2$, and an extensibility value not exceeding 50 Kg.

6. A hot top lining slab or sleeve according to claim 5 wherein the total fibrous element constitutes at least 45% by weight of the slab or sleeve and the total of the organic fibers and particulate refractory materials constitutes not more than 75% of the total weight of the slab or sleeve.

7. A hot top lining slab or sleeve according to claim 6 wherein inorganic fibers are present and have a length to diameter ratio of over 600:1.

8. In a hot top lining slab or sleeve comprising a substantially uniform fibrous mat of at least one element selected from the group consisting of organic and inorganic fibers, the organic fibers being present in an amount of from about 0 to 53% and the inorganic fibers being present in an amount of from about 0 to 60% with the total fiber content being from about 6 to 75% and from about 25 to 94% of a particulate refractory material, from about 0 to 30% of a low density filler and from about 0 to 4% of a binder, all by weight, contained in the fibrous mat, the improvement wherein the organic and inorganic fibers, particulate refractory material, low density filler and binder are present in amounts to provide a refractory, deformable, self-supporting, fibrous mat having in its dry condition a flexibility such that the mat deforms by 0.7 cm. without total fracture under a load not exceeding 20 Kg., a restitution of not more than 30%, a droop of not more than 17 cm, a compressibility value of 0.1 to 1.6 Kg./cm.$^2$, and an extensibility value not exceeding 50 Kg.

9. A sealing ring having a shape adapted to fit the joint between an ingot mould body and a headbox positioned on the mould which comprises a refractory, deformable, self-supporting, substantially uniform fibrous mat having in its dry condition a flexibility such that the ring deforms by 0.7 cm. without total fracture under a load not exceeding 20 Kg., a restitution of not more than 30% and a compressibility of 0.1 to 1.6 Kg./cm.$^2$.

10. A sealing ring according to claim 9 which has a droop of not more than 17 cm.

11. A sealing ring according to claim 9 which has an extensibility not exceeding 50 Kg.

12. A sealing ring according to claim 9 wherein the fibrous mat includes at least 3% by weight of fibers having a length of at least 0.25 cm. and a length to diameter ratio of at least 100:1.

13. A sealing ring having a shape adapted to fit the joint between an ingot mould body and a headbox positioned on the mould which comprises a refractory heat insulating material comprising a substantially uniform fibrous mat of inorganic fibrous material and organic fibrous material and particulate refractory filler contained in the fibrous mat, the total fibrous material constituting at least about 45% by weight of the material, and the total of the organic fibrous material and the particulate refractory filler constituting not more than about 75% by weight of the material, the material having in its dry condition a flexibility such that the material deforms by 0.7 cm. without total fracture under a load not exceeding 20 Kg., a restitution of not more than 30% and a compressibility of 0.1 to 1.6 Kg./cm.$^2$.

14. A sealing ring having a shape adapted to fit the joint between an ingot mould body and a headbox positioned on the mould which comprises a fibrous mat of at least one element selected from the group consisting of organic and inorganic fibers, the organic fibers being present in an amount of from about 0 to 53% and the inorganic fibers being present in an amount of from about 0 to 60% with the total fiber content being from about 6 to 75% and from about 25 to 94% of a particulate refractory material, from about 0 to 20% of a low density filler and from about 0 to 4%, all be weight, contained in the fibrous mat, the organic and inorganic fibers, particulate refractory material, low denstiy filler and binder being present in amounts to provide a refractory, deformable, self-supporting, substantially uniform fibrous mat having in its dry condition a flexibility such that the mat deforms by 0.7 cm. without total fracture under a load not exceeding 20 Kg., a restitution of not more than 30% and a compressibility of 0.1 to 1.6 Kg./cm.$^2$.

* * * * *